US011013286B2

(12) United States Patent
Roundtree

(10) Patent No.: US 11,013,286 B2
(45) Date of Patent: May 25, 2021

(54) IMPACT-ABSORBING HELMET

(71) Applicant: Vernard Roundtree, Bloomington, IN (US)

(72) Inventor: Vernard Roundtree, Bloomington, IN (US)

( * ) Notice: Subject to any disclaimer, the term of this patent is extended or adjusted under 35 U.S.C. 154(b) by 170 days.

(21) Appl. No.: 16/218,058

(22) Filed: Dec. 12, 2018

(65) Prior Publication Data

US 2020/0187581 A1 Jun. 18, 2020

(51) Int. Cl.
*A42B 3/06* (2006.01)
*A42B 3/20* (2006.01)
*A42B 3/12* (2006.01)

(52) U.S. Cl.
CPC ..... *A42B 3/064* (2013.01); *A42B 3/125* (2013.01); *A42B 3/20* (2013.01)

(58) Field of Classification Search
None
See application file for complete search history.

(56) References Cited

U.S. PATENT DOCUMENTS 986,686 A 3/1911 Carney
2,867,811 A * 1/1959 Jones ..... A42B 3/08 2/421
2,950,576 A * 8/1960 Rubenstein ..... E04B 1/383 52/223.13
3,327,316 A * 6/1967 Pukish, Jr. ..... A63B 71/10 2/421
3,619,813 A * 11/1971 Marchello ..... A42B 3/08 2/421
3,916,446 A * 11/1975 Gooding ..... A42B 3/08 2/421
4,051,556 A * 10/1977 Davenport ..... A42B 3/08 2/421
4,330,103 A * 5/1982 Thuries ..... H02B 1/54 248/548
4,651,356 A * 3/1987 Zide ..... A42B 3/08 2/421
4,741,054 A * 5/1988 Mattes ..... A42B 3/08 2/421
4,741,516 A * 5/1988 Davis ..... B60G 17/04 267/64.13
5,204,998 A * 4/1993 Liu ..... F16F 1/3732 2/411
5,347,660 A * 9/1994 Zide ..... A42B 3/08 2/421
5,371,905 A * 12/1994 Keim ..... A42B 3/0473 2/413
5,685,020 A * 11/1997 Powell ..... A42B 3/08 2/421

(Continued)

*Primary Examiner* — Jocelyn Bravo

(57) ABSTRACT

An impact-absorbing helmet for reducing brain trauma includes an inner shell and an outer shell. The inner shell has a bottom and a front that are open. The bottom is configured to insert a head of a user, positioning the front proximate to a face of the user. The outer shell is complementary to and positioned around the inner shell. The outer shell has an edge that is coupled to a rim of the inner shell so that the inner shell and the outer shell define an interior space. A plurality of first springs is positioned in the interior space. Each first spring is coupled to and extends between the inner shell and the outer shell. The first springs are configured to reduce transfer to the inner shell of a force applied to the outer shell.

13 Claims, 6 Drawing Sheets

(56) References Cited

U.S. PATENT DOCUMENTS 5,946,735 A * 9/1999 Bayes ..... A42B 3/08 2/421
5,956,777 A * 9/1999 Popovich ..... A42B 3/20 2/412
6,081,932 A * 7/2000 Kraemer ..... A42B 3/08 2/421
6,298,483 B1 * 10/2001 Schiebl ..... A42B 3/0433 2/421
6,481,024 B1 * 11/2002 Grant ..... A42B 3/08 2/421
6,854,133 B2 * 2/2005 Lee ..... A42B 3/063 2/412
6,934,971 B2 * 8/2005 Ide ..... A42B 3/08 2/425
7,036,151 B2 * 5/2006 Ide ..... A42B 3/08 2/9
7,152,253 B2 * 12/2006 Abelman ..... A42B 3/08 2/421
7,328,462 B1 * 2/2008 Straus ..... A42B 3/067 2/411
7,607,179 B2 * 10/2009 Shih ..... A42B 3/20 2/411
8,899,562 B1 * 12/2014 Staton ..... G08B 21/18 267/140.13
8,959,668 B1 * 2/2015 Ganes ..... A42B 3/205 2/421
9,032,558 B2 * 5/2015 Leon ..... A42B 3/08 2/411
9,314,060 B2 * 4/2016 Giles ..... A42B 3/00
9,388,873 B1 * 7/2016 Phipps ..... A47C 27/06
9,476,478 B2 * 10/2016 Staton ..... A42B 3/063
9,630,671 B1 * 4/2017 Sze ..... A42B 3/006
9,648,920 B1 * 5/2017 Kuntz ..... A42B 3/20
9,756,889 B2 * 9/2017 Infusino ..... A42B 3/08
D803,483 S 11/2017 Bologna
9,949,523 B2 * 4/2018 Klein ..... A42B 3/20
10,010,126 B1 * 7/2018 Shaffer ..... A42B 3/283
10,029,633 B2 * 7/2018 Phipps ..... B60N 2/42
10,092,054 B2 * 10/2018 Williams ..... A42B 3/063
10,092,057 B2 * 10/2018 Kovarik ..... A42B 3/20
10,292,447 B2 * 5/2019 Connelly ..... A42B 3/08
10,315,095 B1 * 6/2019 Sneed ..... A63B 71/10
10,495,174 B1 * 12/2019 Staton ..... A63B 71/10
10,694,803 B2 * 6/2020 Neal ..... A42B 3/20
10,716,352 B2 * 7/2020 Knight ..... A41D 13/015
2004/0003452 A1 * 1/2004 Schiebl ..... A42B 3/08 2/421
2004/0026196 A1 * 2/2004 Huisman ..... B60G 3/01 188/322.16
2004/0040073 A1 * 3/2004 Morrow ..... A42B 3/205 2/424
2004/0168246 A1 * 9/2004 Phillips ..... A42B 3/064 2/411
2006/0059605 A1 * 3/2006 Ferrara ..... A42B 3/064 2/410
2006/0191403 A1 * 8/2006 Hawkins ..... F41H 5/04 89/36.05
2007/0151003 A1 * 7/2007 Shih ..... A42B 3/20 2/424
2008/0163410 A1 * 7/2008 Udelhofen ..... A42B 3/20 2/413
2008/0313791 A1 * 12/2008 Nagely ..... A42B 3/0473 2/425
2009/0077703 A1 * 3/2009 Gabry ..... A41D 13/05 2/16
2012/0036620 A1 * 2/2012 Harris ..... A42B 3/127 2/414
2013/0061371 A1 * 3/2013 Phipps ..... A42B 3/064 2/411
2013/0185837 A1 * 7/2013 Phipps ..... A42B 3/20 2/2.5
2013/0285300 A1 * 10/2013 Shimasaki ..... B60G 15/061 267/221
2013/0298316 A1 * 11/2013 Jacob ..... A42B 3/125 2/414
2014/0000012 A1 * 1/2014 Mustapha ..... A42B 3/064 2/414
2014/0068840 A1 * 3/2014 Nauman ..... A61G 5/1045 2/411
2014/0123371 A1 * 5/2014 Witcher ..... A42B 3/121 2/413
2014/0208486 A1 * 7/2014 Krueger ..... A42B 3/064 2/414
2014/0223646 A1 * 8/2014 Bologna ..... A42B 3/326 2/424
2015/0089722 A1 * 4/2015 Berry ..... A42B 3/064 2/412
2015/0135413 A1 * 5/2015 Mayerovitch ..... A42B 3/125 2/414
2015/0150330 A1 * 6/2015 Andrews ..... A42B 3/127 2/414
2015/0164172 A1 * 6/2015 Linares ..... A42B 3/0473 2/411
2015/0201695 A1 * 7/2015 Shih ..... A42B 3/226 2/9
2016/0029730 A1 * 2/2016 Day ..... F16F 3/0873 2/412
2016/0029733 A1 * 2/2016 Kovarik ..... A63B 71/10 2/411
2016/0040743 A1 * 2/2016 Staton ..... F41C 23/06 2/412
2016/0088884 A1 * 3/2016 Guerra ..... A42B 3/124 2/411
2016/0255900 A1 * 9/2016 Browd ..... A42B 3/121
2016/0287447 A1 * 10/2016 Mooradd ..... A61L 15/44
2017/0112220 A1 * 4/2017 Suddaby ..... A42B 3/0453
2017/0119080 A1 * 5/2017 Allen ..... A42B 3/28
2017/0232327 A1 * 8/2017 Kuntz ..... A42B 3/125 2/413
2017/0303622 A1 * 10/2017 Stone ..... A42B 3/064
2018/0206583 A1 * 7/2018 Neal ..... A42B 3/20
2018/0220730 A1 * 8/2018 Sicking ..... A42B 3/08
2018/0228239 A1 * 8/2018 Day ..... A42B 3/064
2019/0059498 A1 * 2/2019 Kovarik ..... A42B 3/20
2019/0216155 A1 * 7/2019 Zents ..... A42B 3/08
2019/0216159 A1 * 7/2019 Vanhoutin ..... A42B 3/128
2019/0307201 A1 * 10/2019 Neal ..... A42B 3/06

* cited by examiner

IMPACT-ABSORBING HELMET

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to helmets and more particularly pertains to a new helmet for reducing brain trauma.

BRIEF SUMMARY OF THE INVENTION

An embodiment of the disclosure meets the needs presented above by generally comprising an inner shell and an outer shell. The inner shell has a bottom and a front that are open. The bottom is configured to insert a head of a user, positioning the front proximate to a face of the user. The outer shell is complementary to and positioned around the inner shell. The outer shell has an edge that is coupled to a rim of the inner shell so that the inner shell and the outer shell define an interior space. A plurality of first springs is positioned in the interior space. Each first spring is coupled to and extends between the inner shell and the outer shell. The first springs are configured to reduce transfer to the inner shell of a force applied to the outer shell.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
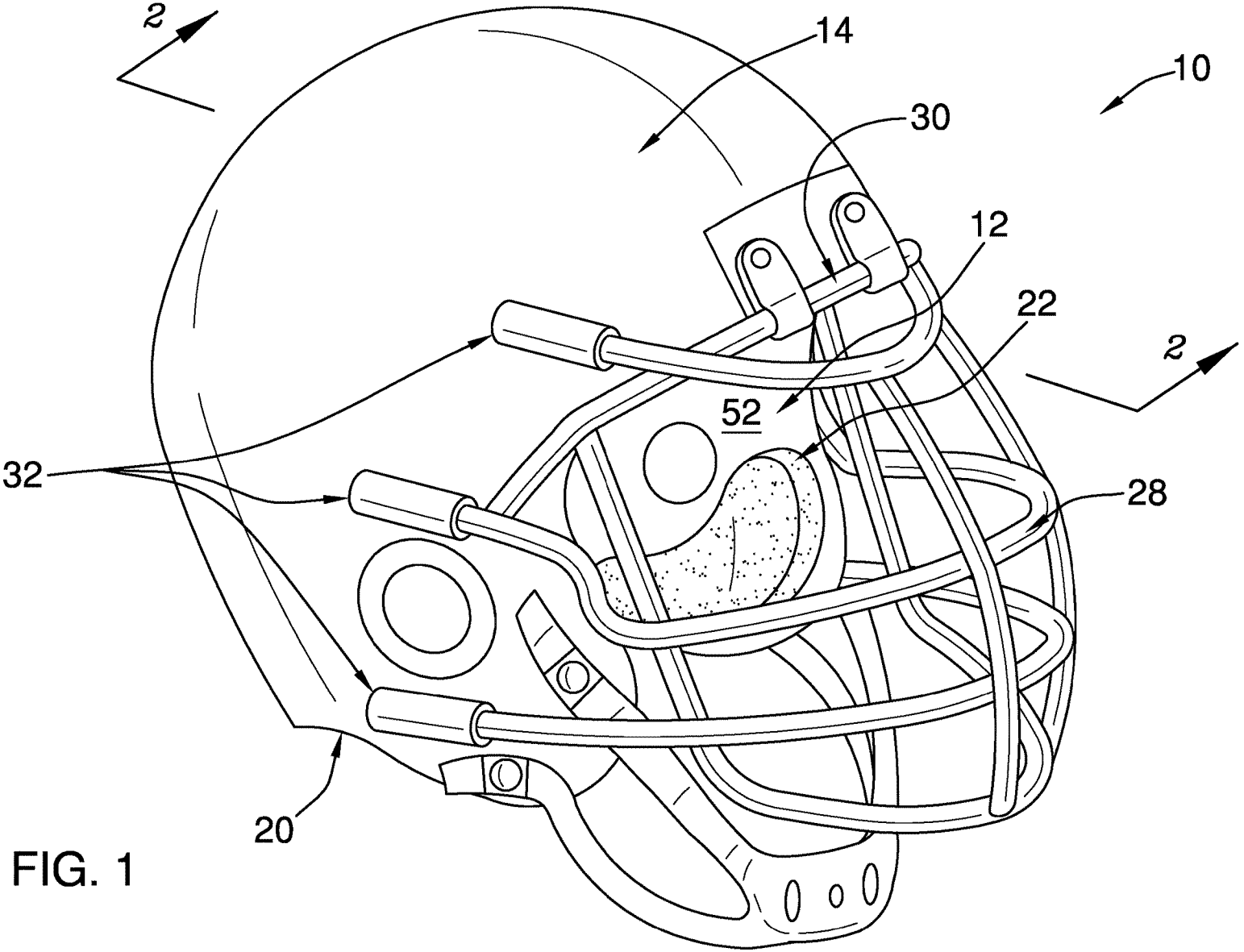
FIG. 1 is an isometric perspective view of an impact-absorbing helmet according to an embodiment of the disclosure.

With reference now to the drawings, and in particular to FIGS. 1 through 6 thereof, a new helmet embodying the principles and concepts of an embodiment of the disclosure and generally designated by the reference numeral 10 will be described.

As best illustrated in FIGS. 1 through 6, the impact-absorbing helmet 10 generally comprises an inner shell 12 and an outer shell 14. The inner shell 12 has a bottom 16 and a front 18 that are open. The bottom 16 is configured to insert a head of a user, positioning the front 18 proximate to a face of the user.

The outer shell 14 is complementary to and positioned around the inner shell 12. The outer shell 14 has an edge 20 that is coupled to a rim 22 of the inner shell 12 so that the inner shell 12 and the outer shell 14 define an interior space 24. The outer shell 14 and the inner shell 12 comprise thermoplastic polymer so that the outer shell 14 and the inner shell 12 are resiliently deformable.

Figure 2:
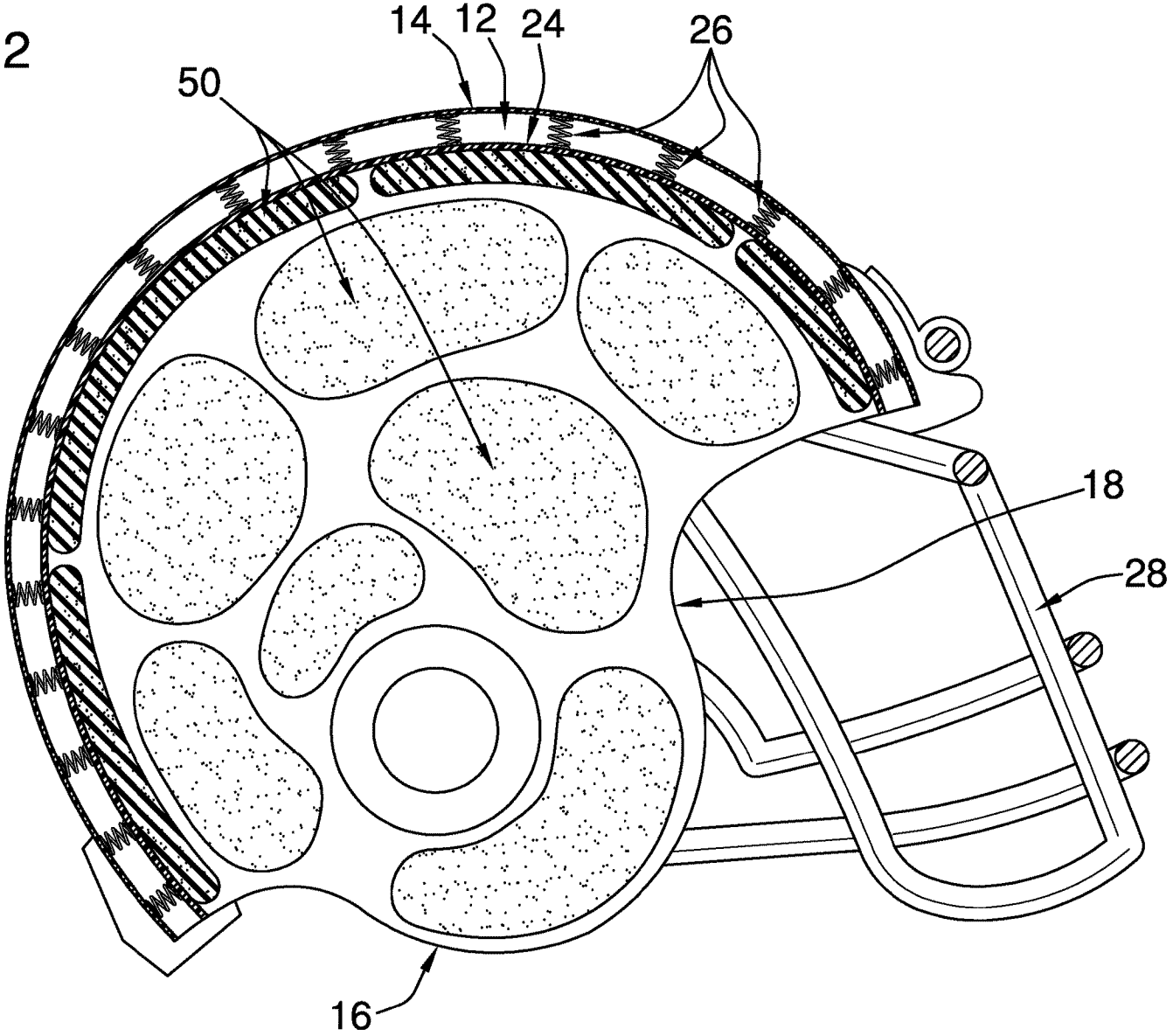
FIG. 2 is a cross-sectional view of an embodiment of the disclosure.
Figure 3:
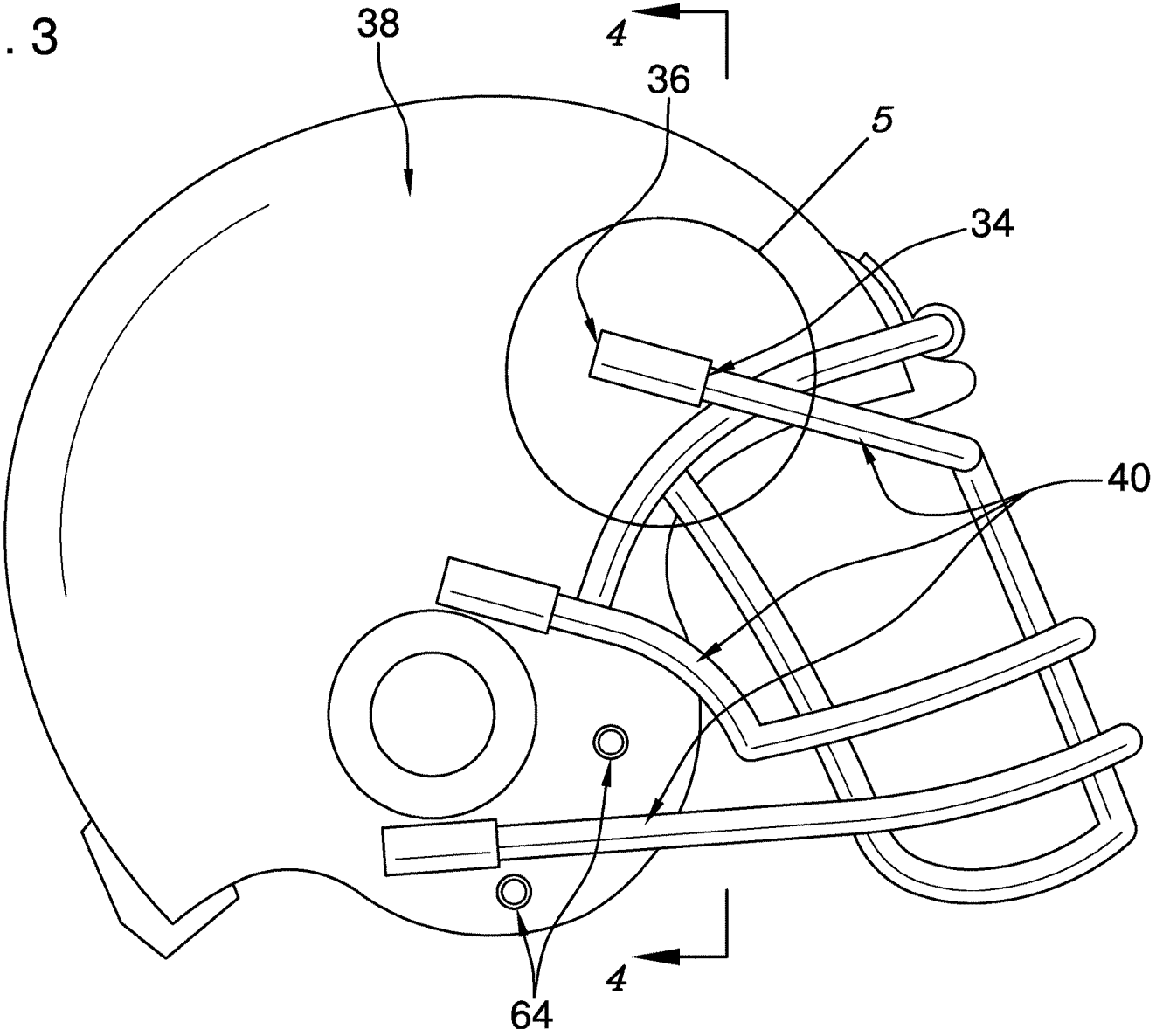
FIG. 3 is a side view of an embodiment of the disclosure.
Figure 4:
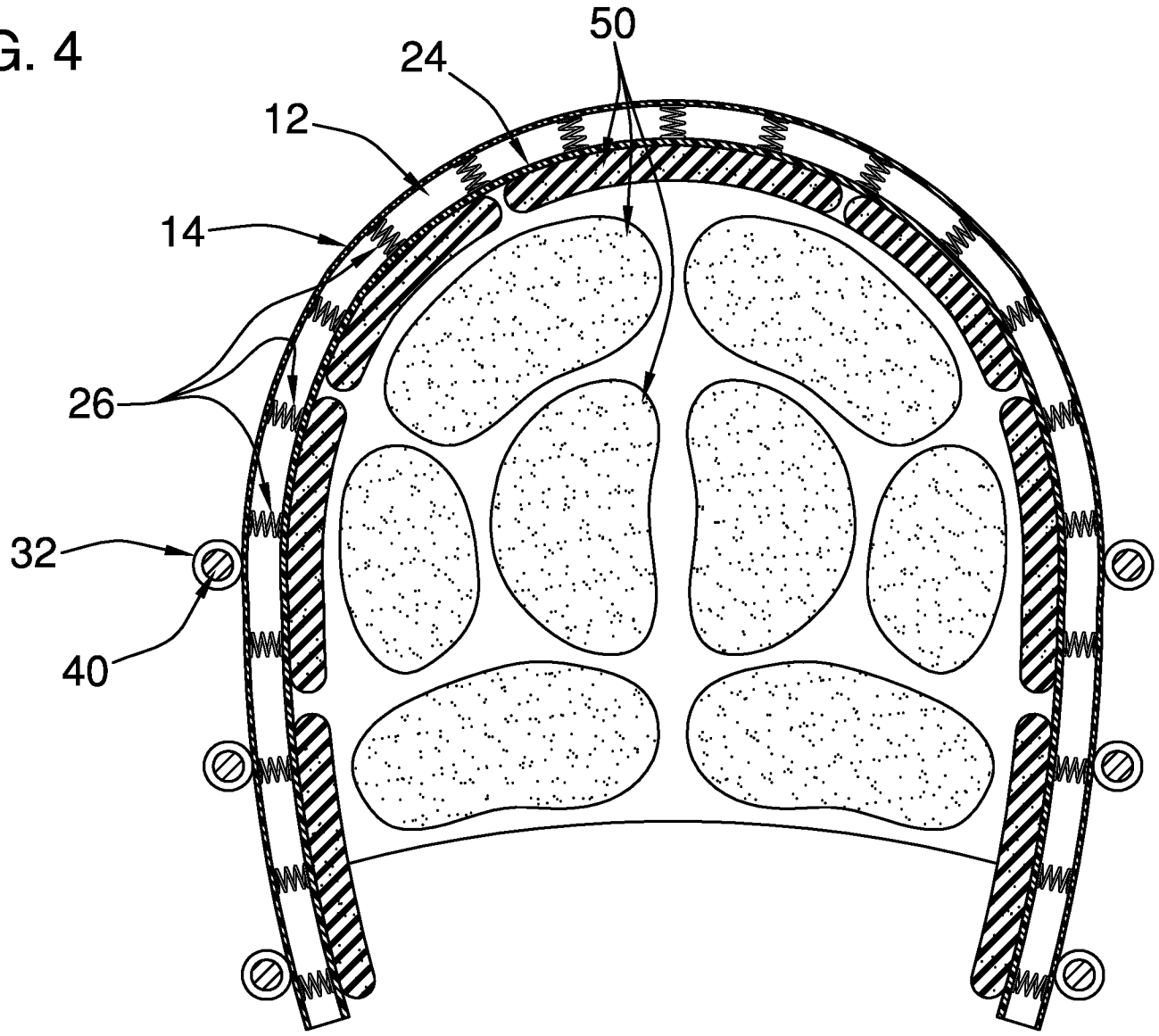
FIG. 4 is a cross-sectional view of an embodiment of the disclosure.
Figure 5:
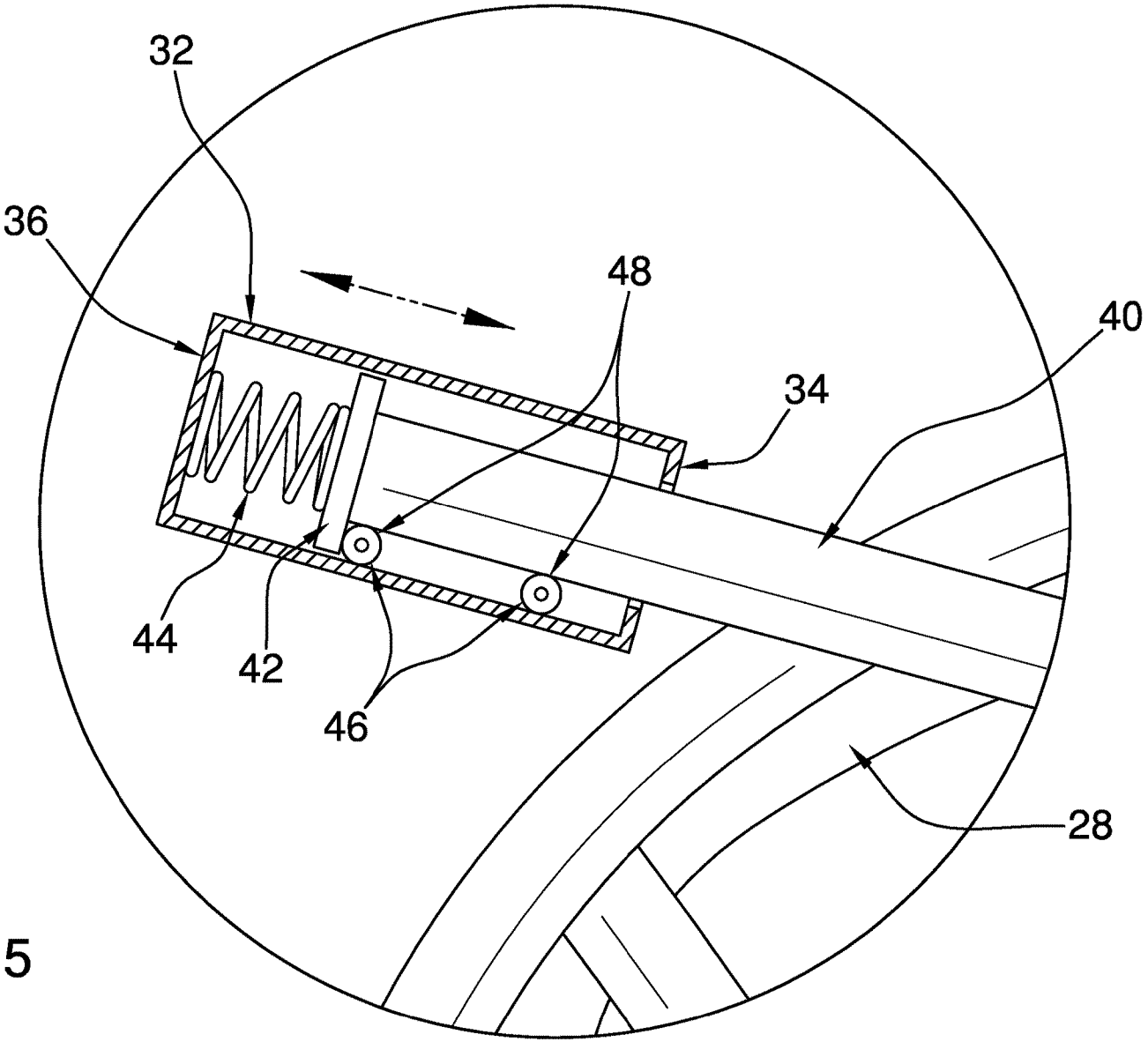
FIG. 5 is a detail view of an embodiment of the disclosure.
Figure 6:
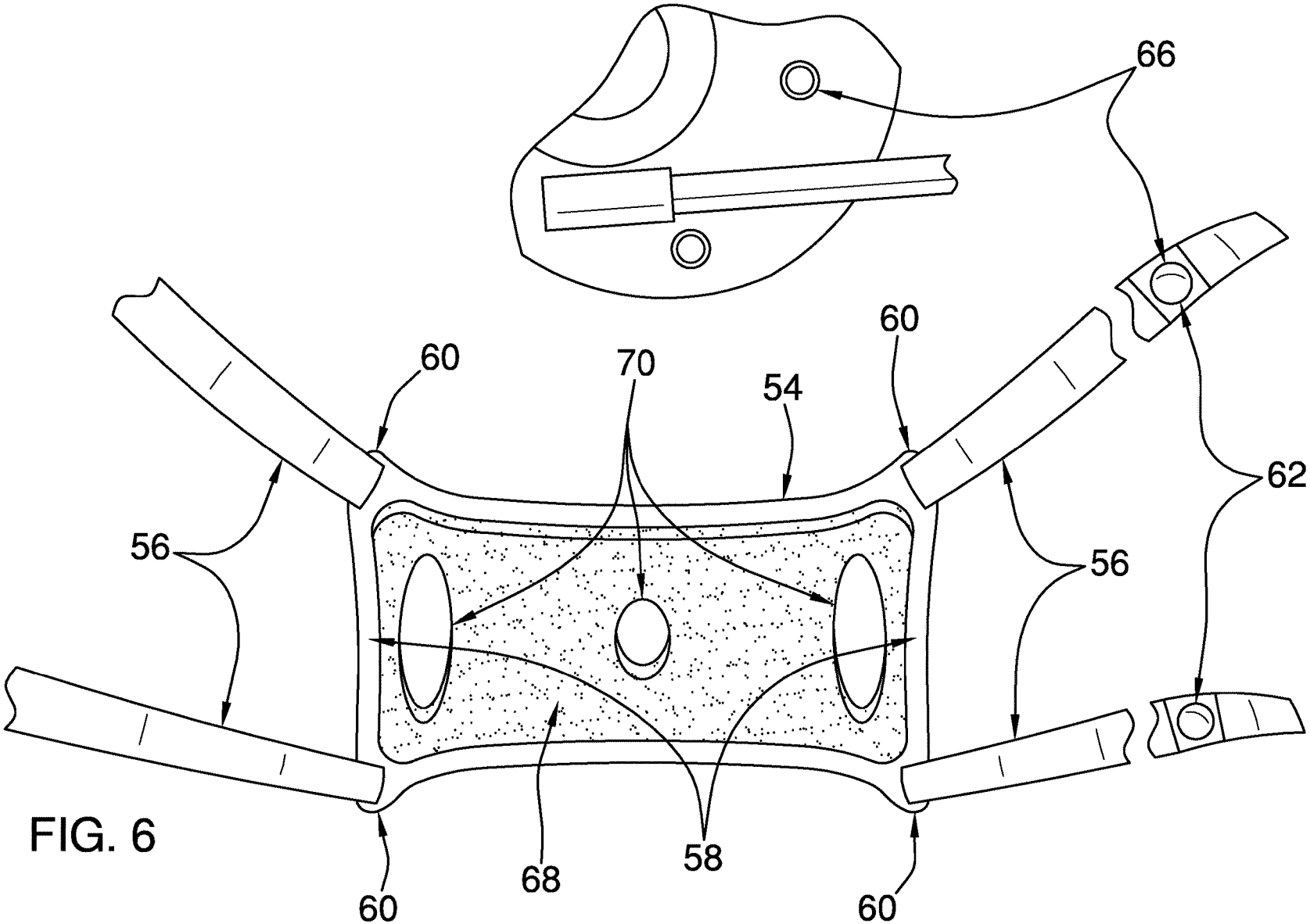
FIG. 6 is an isometric perspective view of an embodiment of the disclosure.

A plurality of first springs 26 is positioned in the interior space 24, as shown in FIGS. 2 and 4. Each first spring 26 is coupled to and extends between the inner shell 12 and the outer shell 14. The first springs 26 are configured to reduce transfer to the inner shell 12 of a force that is applied to the outer shell 14.

A grate 28 is pivotally coupled by an upper end 30 to the outer shell 14 so that the grate 28 is positioned to cover the front 18 of the inner shell 12, as shown in FIG. 1. The grate 28 is configured to protect the face of the user.

A plurality of cylinders 32 is coupled to the outer shell 14 so that a first end 34 of each cylinder 32 is positioned proximate to the front 18. The first end 34 is open. Each cylinder 32 has a second end 36 that is closed. The plurality of cylinders 32 comprises six cylinders 32 that are positioned three-apiece on opposing sides 38 of the outer shell 14, as shown in FIG. 4.

A plurality of rods 40 is coupled to the grate 28. Each rod 40 extends into an associated cylinder 32. The rod 40 is circumferentially smaller than the associated cylinder 32. Each of a plurality of plates 42 is coupled to a respective rod 40 distal from the grate 28. The plate 42 is circumferentially complementary to the associated cylinder 32.

Each of a plurality of second springs 44 is coupled to and extends between the second end 36 of a respective cylinder 32 and an associated plate 42. The second spring 44 is positioned to be tensioned as the plate 42 is urged toward the second end 36 of the respective cylinder 32 by a force that is applied to the grate 28 to reduce transfer to the outer shell 14 of the force that is applied to the grate 28. The second spring 44 is configured to rebound to urge the rod 40 distally from the second end 36 of the respective cylinder 32 when the force is removed from the grate 28.

Each of a plurality of bearings 46 is coupled to and positioned in a respective cylinder 32. The bearing 46 is positioned to facilitate movement of an associated rod 40 within the respective cylinder 32. Each bearing 46 comprises a plurality of wheels 48.

Each of a plurality of first pads 50 is coupled to an outer surface 52 of the inner shell 12, as shown in FIGS. 2 and 4, so that the plurality of first pads 50 abuts the head of the user. The first pads 50 are configured to reduce transfer to the head of the user of a force that is applied to inner shell 12. The first pads 50 comprises silicone.

The helmet 10 also comprises a panel 54 that is substantially rectangularly shaped and which comprises leather. Each of a plurality of straps 56 is coupled to and extends from a respective opposing end 58 of the panel 54. The plurality of straps 56 comprises four straps 56 that are coupled singly proximate to each corner 60 of the panel 54.

Each of a plurality of first couplers 62 is coupled to a respective strap 56 distal from the panel 54. Each of a plurality of second couplers 64 is coupled to the outer shell 14 proximate to the front 18 of the inner shell 12. The second couplers 64 are complementary to the first couplers 62. Each second coupler 64 is positioned to selectively couple to a respective first coupler 62 so that the panel 54 is positioned over a chin of the user. The plurality of straps 56 is configured to couple the outer shell 14 to the head of the user. The second coupler 64 and the respective first coupler 62 comprise a snap closure 66.

A second pad 68 is coupled to the panel 54 so that the second pad 68 is positioned between the panel 54 and the chin of the user. The second pad 68 is positioned to cushion the panel 54. The second pad 68 comprises silicone. Each of a plurality of apertures 70 extends through the panel 54 and the second pad 68. The plurality of apertures 70 is configured to allow air exchange across the panel 54 and the second pad 68.

In use, the user dons the helmet 10 and secures it to his or her head with the straps 56 using the snap closures 66. The first springs 26, the second springs 44, and the first pads 50 are configured to reduce the force that is transferred to the head of impacts to the helmet 10, which reduces trauma to the brain of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An impact-absorbing helmet comprising:

an inner shell, the inner shell having a bottom and a front, the bottom and the front being open; wherein the bottom is configured for receiving a head of a user and the front is configured to be positioned proximate to a face of the user;

an outer shell complementary to the inner shell and positioned around the inner shell, the outer shell having an edge coupled to a rim of the inner shell such that the inner shell and the outer shell define an interior space;

a plurality of first springs positioned in the interior space, each first spring being coupled to, and extending between, the inner shell and the outer shell, wherein the first springs are configured for reducing transfer to the inner shell of a force applied to the outer shell;

a grate pivotally coupled at an upper end of the grate to the outer shell such that the grate is positioned for covering the front of the inner shell, wherein the grate is configured for protecting the face of the user;

a plurality of cylinders coupled to the outer shell, each cylinder having an open first end and a closed second end, wherein the first end of each cylinder is positioned proximate to the front;

a plurality of rods coupled to the grate, each rod extending into a respective cylinder of the plurality of cylinders, each rod being circumferentially smaller than the respective cylinder;

a plurality of plates, each plate being coupled to a distal end of a respective rod of the plurality of rods, each plate being circumferentially complementary to the respective cylinder;

a plurality of second springs, each second spring being coupled to, and extending between, the closed second end of a respective cylinder of the plurality of cylinders and a respective plate of the plurality of plates, wherein each second spring is positioned for tensioning as the respective plate is urged toward the closed second end of the respective cylinder by a force applied to the grate, for reducing transfer to the outer shell of the force applied to the grate, and wherein each second spring is configured for rebounding for urging the respective plate away from the closed second end of the respective cylinder when the force is removed from the grate; and a plurality of bearings, each bearing being coupled to and positioned in a respective cylinder of the plurality of cylinders, wherein each bearing is positioned for facilitating movement of the respective rod within the respective cylinder, each bearing comprising a plurality of wheels.

2. The helmet of claim 1, further including wherein the outer shell and the inner shell comprise thermoplastic polymer such that the outer shell and the inner shell are resiliently deformable.

3. The helmet of claim 1, wherein the plurality of cylinders comprise six cylinders positioned three-apiece on opposing sides of the outer shell.

4. The helmet of claim 1, further including a plurality of first pads coupled to an inner surface of the inner shell such that the plurality of first pads is configured to abut the head of the user, and wherein the first pads are configured for reducing transfer to the head of the user of a force applied to the inner shell.

5. The helmet of claim 4, wherein the first pads comprise silicone.

6. The helmet of claim 1, further comprising:

a panel;

a plurality of straps, each strap being coupled to and extending from a respective opposing end of the panel;

a plurality of first couplers, each first coupler being coupled to a distal portion of a respective strap of the plurality of straps;

a plurality of second couplers coupled to the outer shell proximate to the front of the inner shell, the second couplers being complementary to the first couplers, wherein each second coupler is positioned for selectively coupling to a respective first coupler of the plurality of first couplers, such that the panel is configured to be positioned over a chin of the user, and wherein the plurality of straps is configured for coupling the outer shell to the head of the user; and a second pad coupled to the panel such that the second pad is configured to be positioned between the panel and the chin of the user wherein the second pad is positioned for cushioning the panel.

7. The helmet of claim 6, wherein the panel is substantially rectangularly shaped.

8. The helmet of claim 7, wherein the panel comprises leather.

9. The helmet of claim 7, wherein the panel comprises corners, the plurality of straps comprising four straps coupled singly proximate to each corner of the panel.

10. The helmet of claim 7, wherein each second coupler and each first coupler comprises a snap closure.

11. The helmet of claim 7, wherein the second pad comprises silicone.

12. The helmet of claim 7, further including a plurality of apertures, each aperture extending through the panel and the second pad, wherein the plurality of apertures is configured for air exchange across the panel and the second pad.

13. An impact-absorbing helmet comprising:

an inner shell, the inner shell having a bottom and a front, the bottom and the front being open; wherein the bottom is configured for receiving a head of a user and the front is configured to be positioned positioning the front proximate to a face of the user;

an outer shell complementary to the inner shell and positioned around the inner shell, the outer shell having an edge coupled to a rim of the inner shell such that the inner shell and the outer shell define an interior space, the outer shell and the inner shell comprising thermoplastic polymer such that the outer shell and the inner shell are resiliently deformable;

a plurality of first springs positioned in the interior space, each first spring being coupled to, and extending between, the inner shell and the outer shell, wherein the first springs are configured for reducing transfer to the inner shell of a force applied to the outer shell;

a grate pivotally coupled at an upper end of the grate to the outer shell such that the grate is positioned for covering the front of the inner shell, wherein the grate is configured for protecting the face of the user;

a plurality of cylinders coupled to the outer shell, each cylinder having an open first end and a closed second end, wherein the first end of each cylinder is positioned proximate to the front, the plurality of cylinders comprising six cylinders positioned three-apiece on opposing sides of the outer shell;

a plurality of rods coupled to the grate, each rod extending into a respective cylinder of the plurality of cylinders, each rod being circumferentially smaller than the respective cylinder;

a plurality of plates, each plate being coupled to a distal end of a respective rod of the plurality of rods, each plate being circumferentially complementary to the respective cylinder;

a plurality of second springs, each second spring being coupled to, and extending between, the closed second end of a respective cylinder of the plurality of cylinders and a respective plate of the plurality of plates, wherein each second spring is positioned for tensioning as the respective plate is urged toward the closed second end of the respective cylinder by a force applied to the grate, for reducing transfer to the outer shell of the force applied to the grate, and wherein each second spring is configured for rebounding for urging the respective plate away from the closed second end of the respective cylinder when the force is removed from the grate;

a plurality of bearings, each bearing being coupled to and positioned in a respective cylinder of the plurality of cylinders, wherein each bearing is positioned for facilitating movement of the respective rod within the respective cylinder, each bearing comprising a plurality of wheels;

a plurality of first pads coupled to an inner surface of the inner shell such that the plurality of first pads are configured to abut the head of the user, wherein the first pads are configured for reducing transfer to the head of the user of a force applied to the inner shell, the first pads comprising silicone;

a panel, the panel being substantially rectangularly shaped and having corners, the panel comprising leather;

a plurality of straps, each strap being coupled to and extending from a respective opposing end of the panel, the plurality of straps comprising four straps coupled singly proximate to each corner of the panel;

a plurality of first couplers, each first coupler being coupled to a distal portion of a respective strap of the plurality of straps;

a plurality of second couplers coupled to the outer shell proximate to the front of the inner shell, the second couplers being complementary to the first couplers, wherein each second coupler is positioned for selectively coupling to a respective first coupler of the plurality of first couplers, such that the panel is configured to be positioned over a chin of the user, and wherein the plurality of straps is configured for coupling the outer shell to the head of the user, each second coupler and each first coupler comprising a snap closure;

a second pad coupled to the panel such that the second pad is configured to be positioned between the panel and the chin of the user, wherein the second pad is positioned for cushioning the panel, the second pad comprising silicone; and a plurality of apertures, each aperture extending through the panel and the second pad, wherein the plurality of apertures is configured for air exchange across the panel and the second pad.

* * * * *